US007011151B2

(12) United States Patent
McGarian et al.

(10) Patent No.: US 7,011,151 B2
(45) Date of Patent: Mar. 14, 2006

(54) SEALED LATERAL WELLBORE JUNCTION

(75) Inventors: Bruce McGarian, Stonehaven (GB); Robert I. Chadwick, Badentoy Park (GB); Gary A. Taylor, Ellon (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/276,921

(22) PCT Filed: May 22, 2001

(86) PCT No.: PCT/GB01/02283

§ 371 (c)(1),
(2), (4) Date: Feb. 24, 2003

(87) PCT Pub. No.: WO01/90533

PCT Pub. Date: Nov. 29, 2001

(65) Prior Publication Data

US 2004/0011529 A1 Jan. 22, 2004

(30) Foreign Application Priority Data

May 22, 2000 (GB) ..... 0012386
May 23, 2000 (GB) ..... 0012545
May 26, 2000 (GB) ..... 0012932
Jun. 2, 2000 (GB) ..... 0013499

(51) Int. Cl.
*E21B 7/08* (2006.01)
*E21B 43/14* (2006.01)

(52) U.S. Cl. ..... 166/50; 166/117.6; 166/313
(58) Field of Classification Search ..... 166/50, 166/117.6, 313, 117.5
See application file for complete search history.

(56) References Cited

U.S. PATENT DOCUMENTS

| | | | | |
|---|---|---|---|---|
| 2,397,070 A * | 3/1946 | Zublin | 166/50 |
| 5,388,648 A | 2/1995 | Jordan, Jr. | 166/380 |
| 5,462,120 A * | 10/1995 | Gondouin | 166/380 |
| 5,735,350 A | 4/1998 | Longbottom et al. | 166/313 |
| 5,787,987 A | 8/1998 | Forsyth et al. | 166/313 |
| 6,012,516 A | 1/2000 | Brunet | 166/50 |
| 6,012,526 A | 1/2000 | Jennings et al. | 166/298 |
| 6,070,665 A * | 6/2000 | Singleton et al. | 166/298 |
| 6,073,697 A * | 6/2000 | Parlin et al. | 166/313 |
| 6,079,488 A * | 6/2000 | Begg et al. | 166/50 |

FOREIGN PATENT DOCUMENTS

| | | |
|---|---|---|
| GB | 2 332 396 | 8/1998 |
| GB | 2 327 964 | 2/1999 |
| GB | 2 330 159 | 4/1999 |

(Continued)

OTHER PUBLICATIONS

Jonas Lindvall, et al., Multilateral Tieback Insert Provides a Low Cost, . . . Junction, Aug. 11, 1999.

*Primary Examiner*—Hoang Dang
(74) *Attorney, Agent, or Firm*—Dykema Gossett PLLC

(57) ABSTRACT

The present invention relates to downhole drilling operations, and more particularly, to the completion of lateral boreholes. Apparatus (100) is provided comprising a tubular liner portion (108) for lining a portion of a lateral borehole adjacent an opening of a borehole into the lateral borehole. An end portion of said tubular liner portion (108) is provided with a flange element (102) having a curved surface for locating in abutment with an area of main borehole surrounding said opening. A method of using said apparatus (100) is also provided.

14 Claims, 17 Drawing Sheets

FOREIGN PATENT DOCUMENTS

| | | |
|---|---|---|
| GB | 2 332 919 | 7/1999 |
| WO | WO 97/06345 | 2/1997 |
| WO | WO 98/58151 | 12/1998 |
| WO | WO 99/04135 | 1/1999 |

* cited by examiner

SEALED LATERAL WELLBORE JUNCTION

The present invention relates to downhole drilling operations and, more particularly, to the completion of lateral boreholes.

One object of any lateral borehole completion operation is to provide a means of preventing shale transfer between the main borehole (leg 1) and the lateral borehole (leg 2). It is particularly desirable to prevent the ingress of shale from the lateral leg, through the window, and into the main leg. A consequence of such an ingress can be a plugging of production.

The problem of providing an adequate sealing of lateral boreholes during a lateral completion operation is discussed in the Society of Petroleum Engineers (SPE) paper 57540. The paper provides a solution to the problem, namely the MX sleeve or multi-lateral Tie Back Insert (MLTBI as it was originally known). Whilst this proposed system may be operated effectively, it does not allow fill re-entry to both the main borehole (leg 1) and the lateral borehole (leg 2). Although the lateral borehole is mechanically accessible, the main borehole is merely hydraulically accessible. Modification to the proposed system may allow mechanical access to the main borehole as well as the lateral borehole, but this access would be very limited. It is of course desirable to provide full bore access to both legs so as to allow unrestricted use of conventional downhole equipment.

A further solution is the "hook" hanger (or liner) system discussed in U.S. Pat. No. 5,477,925. With reference to FIG. 1 of the accompanying drawings, it will be understood that the aforementioned hook hanger system comprises a hook liner 2 of a generally cylindrical shape. The liner 2 is provided with a preformed opening 4. The geometry of the opening 4 is such that, when a lower end 6 of the liner 2 has passed through a casing window and into an associated lateral borehole, said opening 4 can be aligned in such a way as to provide full mechanical access to the portion of main borehole located downhole of the main/lateral junction. More specifically, the liner 2 can be arranged so as to project from the lateral borehole with the opening 4 spanning the main borehole and facing downhole.

In addition to the opening 4, two ribs 8 are located diametrically opposite one another on the external cylindrical surface of the liner 2. Each rib 8 extends helically along the length of the liner 2 and, in use, undertakes a "hooking" role wherein the portion of casing adjacent the window is engaged by each rib 8 so as to ensure that the opening 4 is located correctly.

The prior art hook hanger system is employed once a window mill 10 and whipstock 12 have been used, in a conventional manner, to cut a window 14 in the casing 16 of a main borehole (as shown in FIGS. 2 and 3). A lateral borehole is then drilled from the window 14 into surrounding formation. The aforementioned system is then used to line and thereby seal the lateral borehole. This is achieved by attaching a tubing string (by means of a crossover element) to the lower end 6 of the liner 2 and running the tubing string (followed by the liner 2) into the lateral borehole. Conveying of the tubing string (not shown) through the lateral borehole is preferably assisted by means of a bent joint. Once the tubing string has been fully deployed in the lateral borehole, the lower end 6 of the liner 2 is passed through the window 14. The ribs 8 then locate against the window profile.

Entry into the lined lateral is achieved using a string comprising a further bent joint and suitable guide means. The guide means may be a mule shoe giving an orientation of the leg on the bullnose relative to the bent joint entry to either leg 1 (i.e. the main borehole) or leg 2 (i.e. the lateral borehole).

With regard to entry into the portion of main borehole located below the main/lateral junction, it will be noted that the widest section 18 of the casing window 14 extends for only a relatively short distance downhole. It is through this widest section 18 that the tubing string and lower end 6 of the liner 2 is run. However, it will be appreciated that, in order to ensure adequate clearance for insertion through the window 6, the liner 2 must be somewhat narrower than said window section 18. As a result, an undesirably restrictive lateral borehole can result.

Embodiments of the present invention will now be described with reference to the accompanying drawings, in which.

Figure 17:
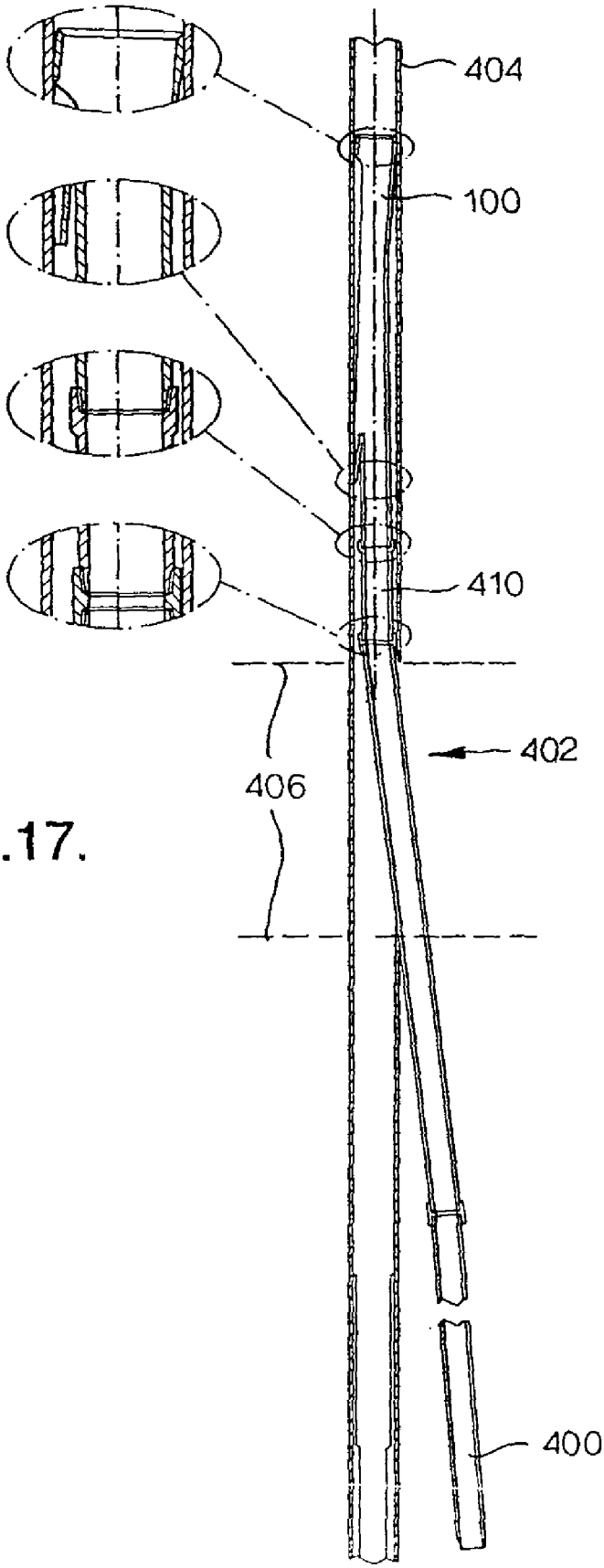
Figure 18:
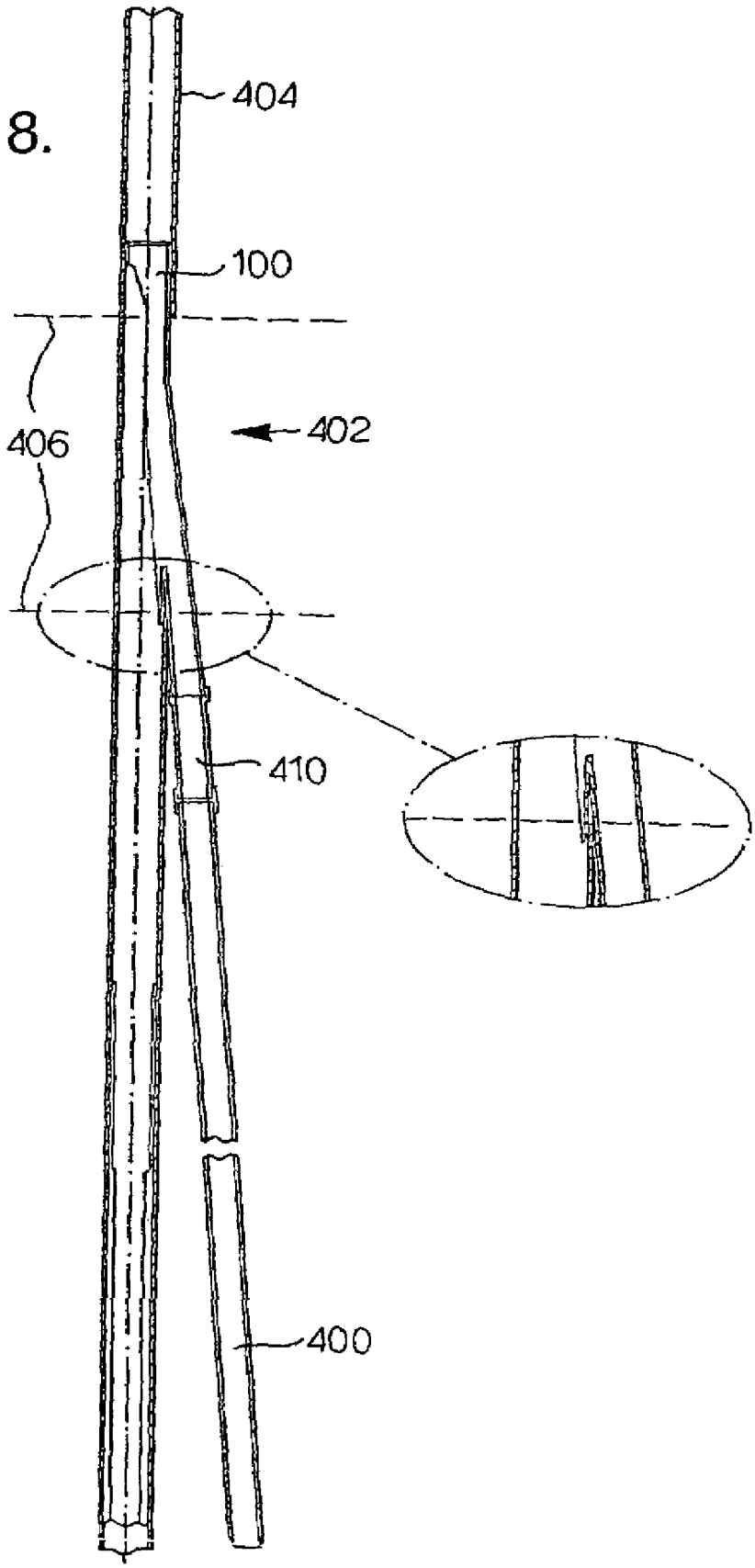
Figure 19:
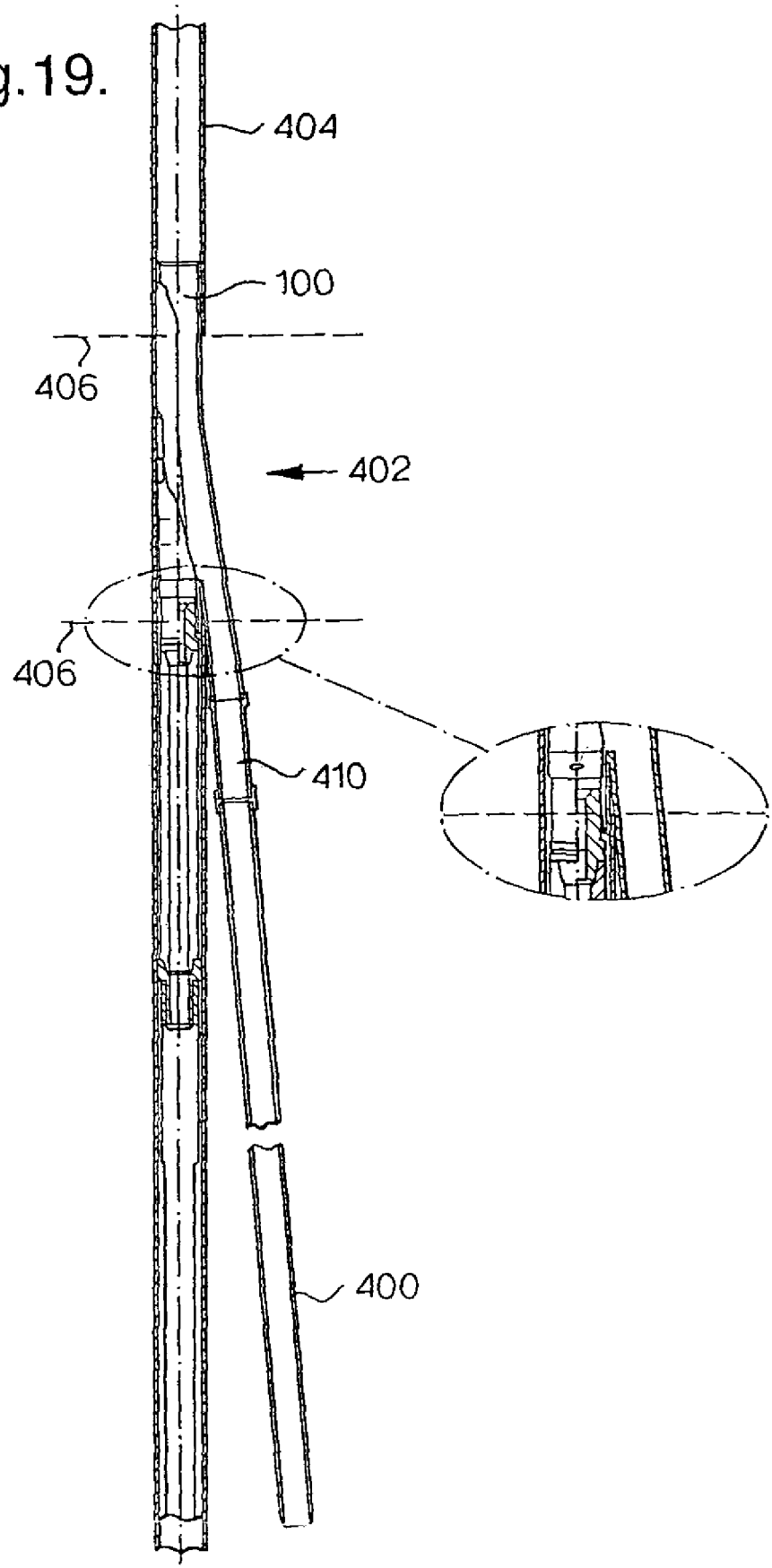
Figure 20:
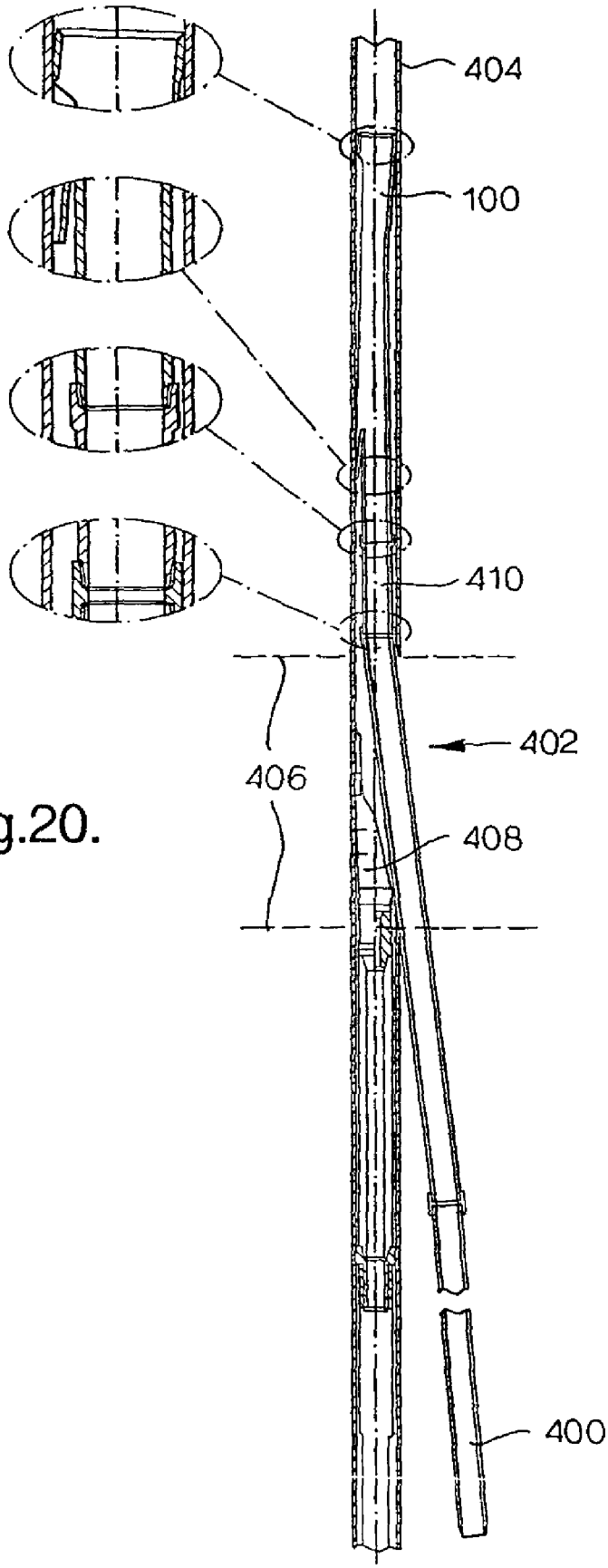
Figure 21:
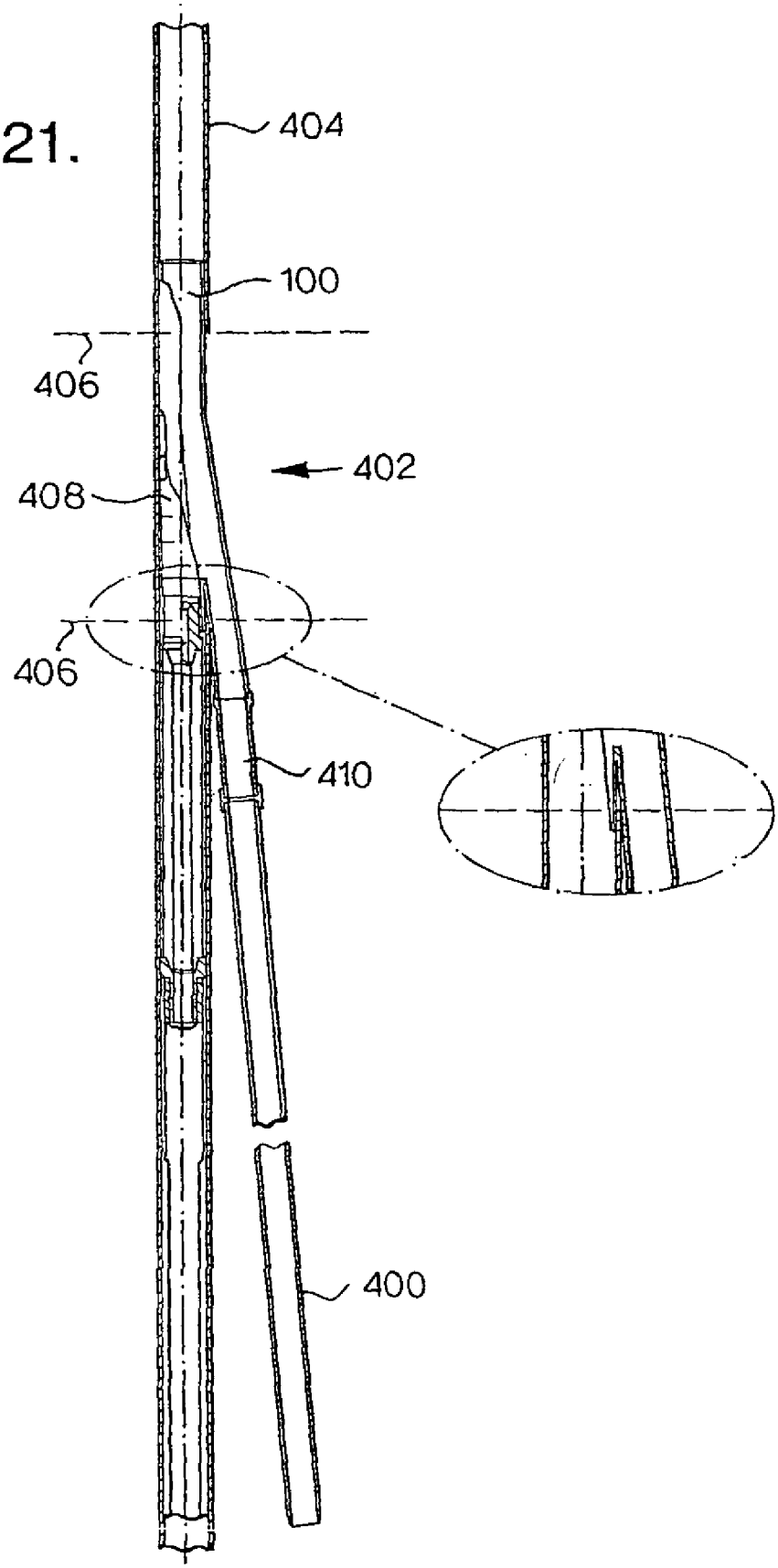
Figure 22:
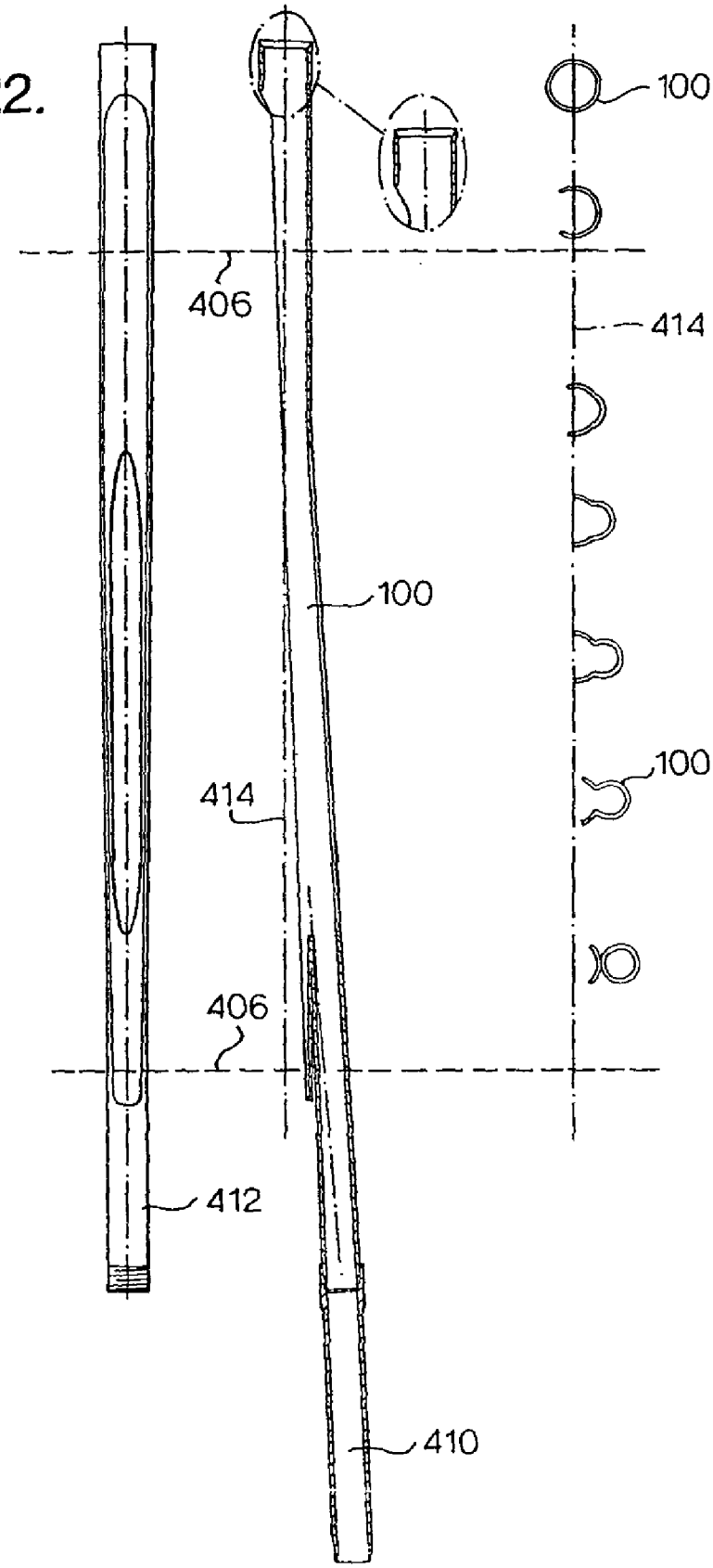
Figure 23:
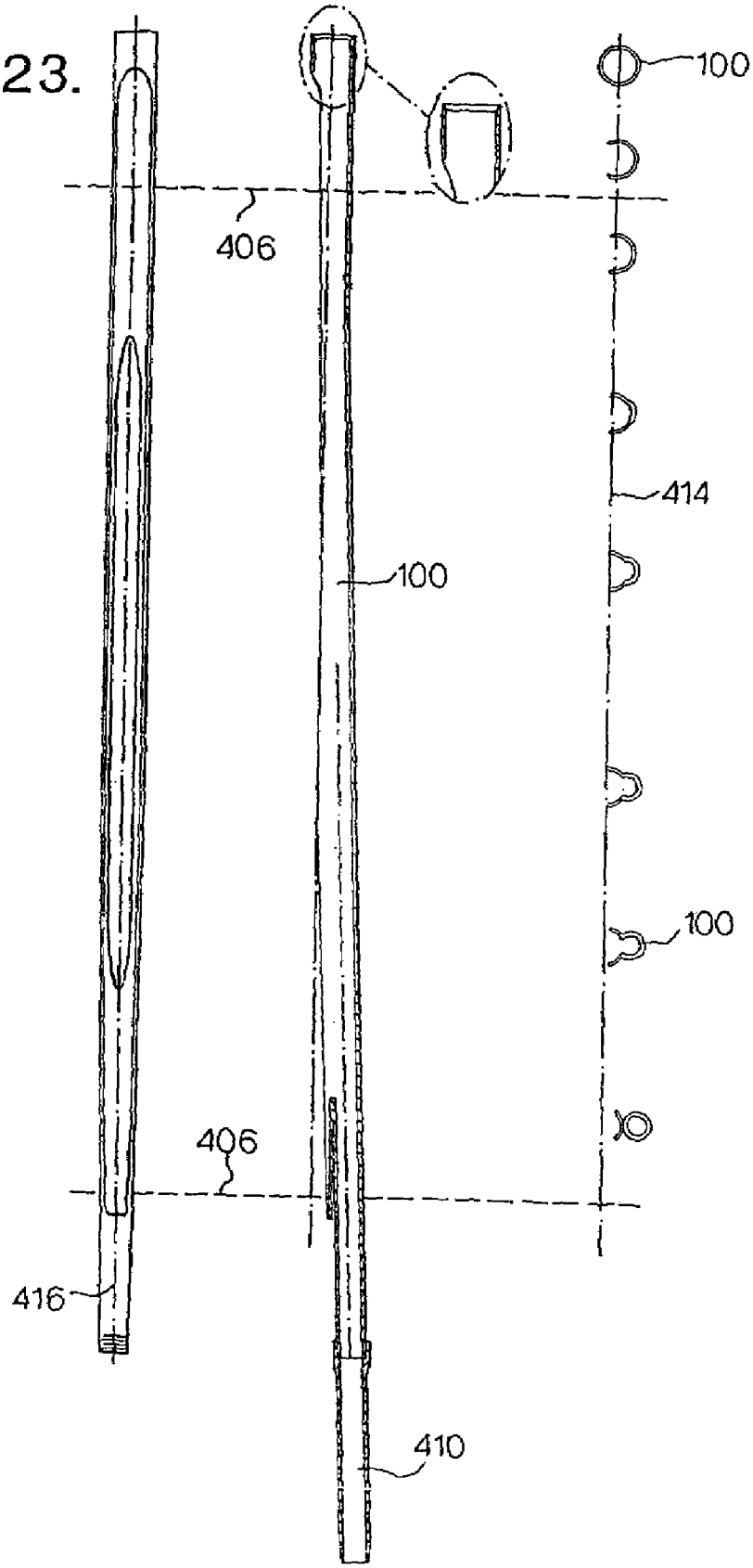
Figure 24:
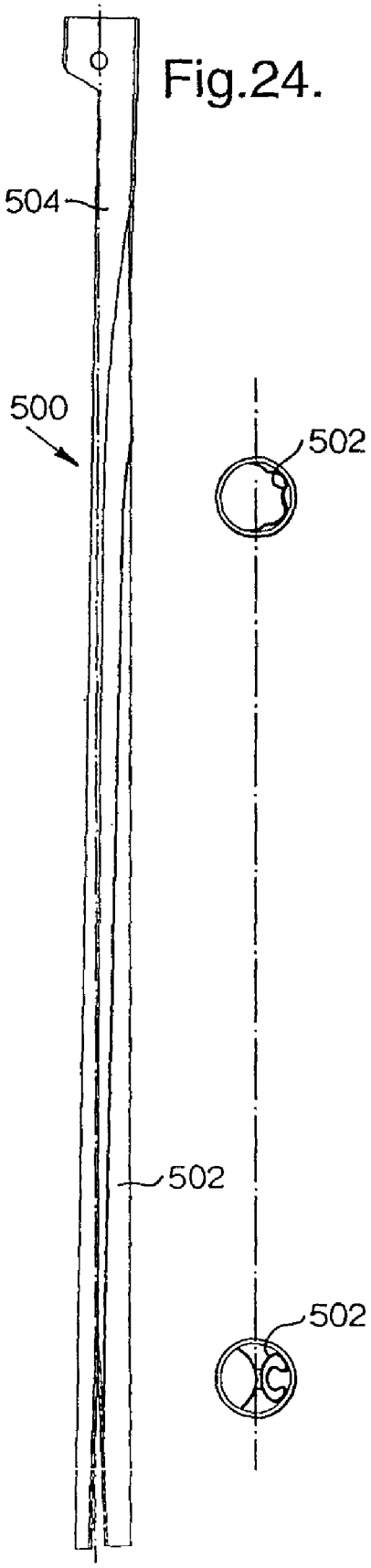
Figure 25:
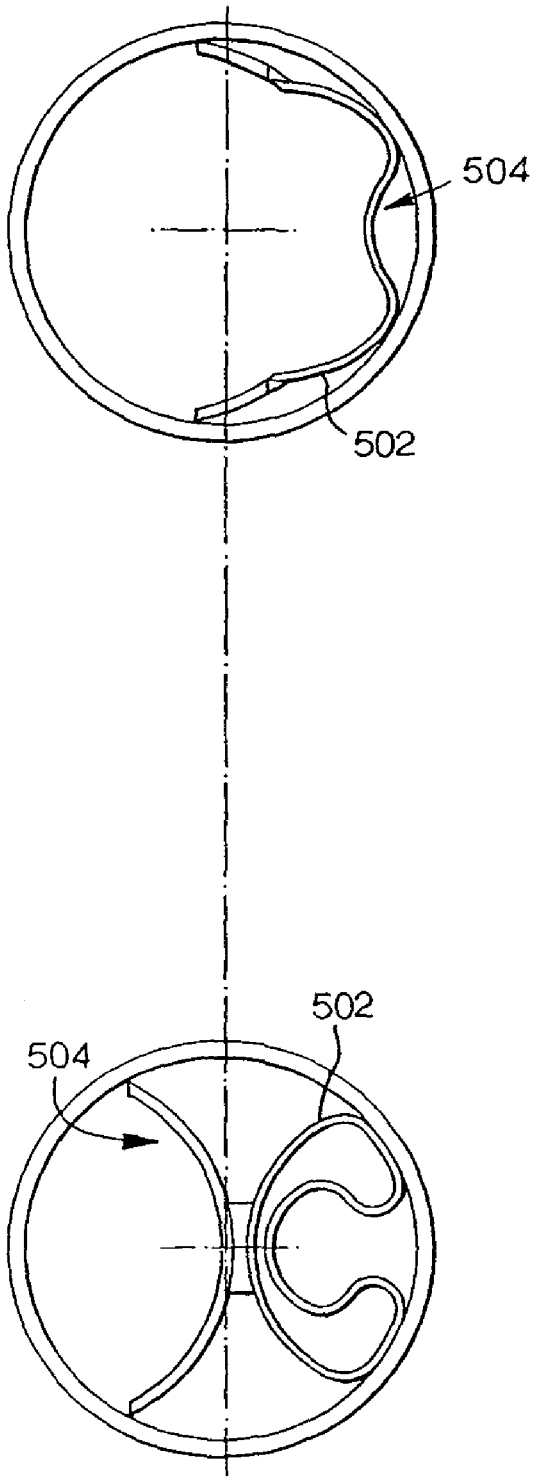
Figure 26:
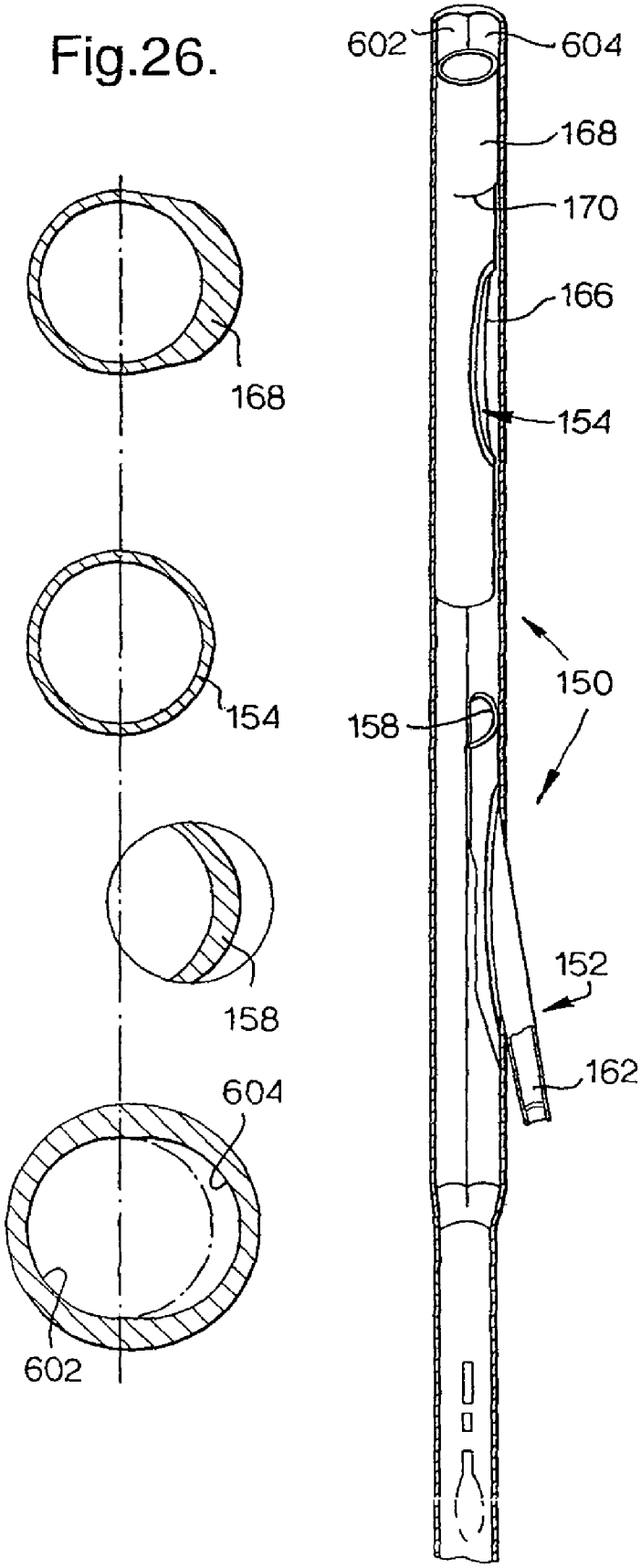
Figure 27:
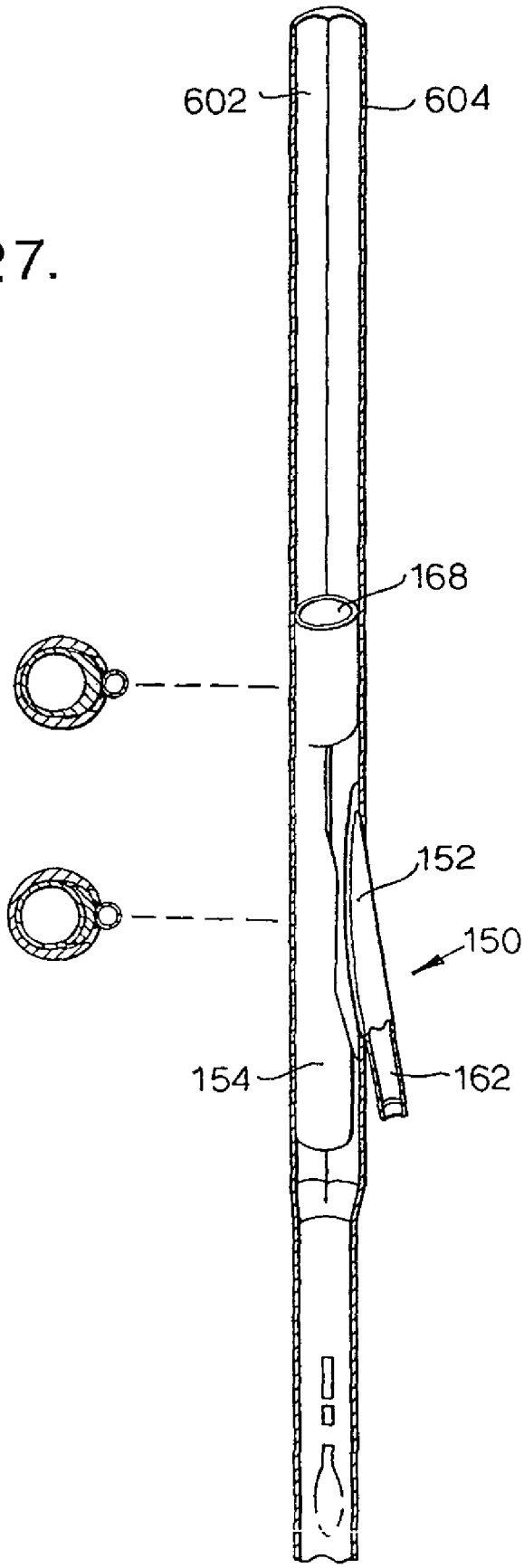

FIGS. 17 to 19 schematically show a flange liner being run into a lateral borehole which has not been provided with an undercut;

FIGS. 20 and 21 schematically show a flange liner being run into a lateral borehole which has been provided with an undercut;

FIG. 22 schematically shows window and deployed flange liner positions relative to a widetrack whipstock;

FIG. 23 schematically shows window and deployed flange liner positions relative to a gauge max whipstock;

FIGS. 24 and 25 schematically show a sixth embodiment of the present invention comprising a collapsed lateral liner portion; and FIGS. 26 and 27 schematically show use of the fourth flange liner in an eccentric wellbore casing.

Figure 4:
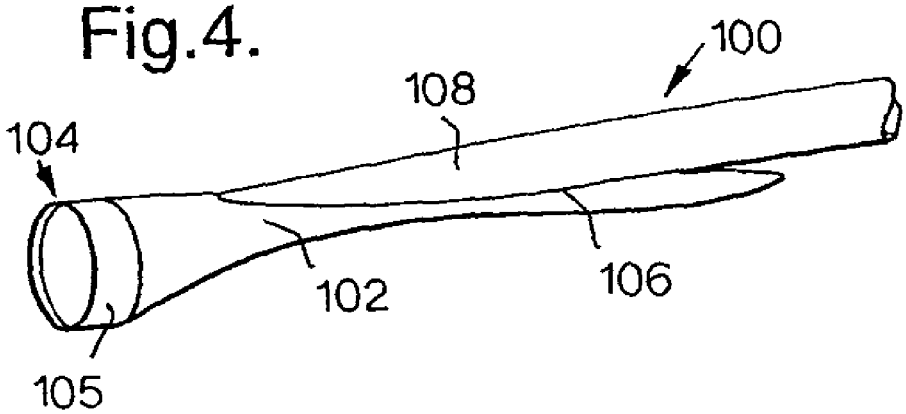
FIG. 4 is a schematic perspective view of a first embodiment of the present invention.

A first embodiment 100 of the present invention is shown schematically in the perspective view of FIG. 4. The first embodiment 100 may be termed a "flange" liner since it comprises a flange part constructed from a tubular element 102. The tubular element 102 is profiled so as to enable its diameter to be accommodated within a slightly larger tubular (i.e. a main borehole casing). An uphole end 104 of the tubular element 102 is cylindrical in shape, whereas the portion of tubular element 102 downhole of said uphole end 104 is merely part cylindrical (i.e. open on one side). More specifically, said uphole end 104 is provided with a part spherical node 105 which, in use, assists in centralising the tubular element 102 within a main borehole regardless of the angle of said element 102 to said main borehole. Also, the tubular element 102 is provided with an elliptical aperture 106. The aperture 106 is elongate and extends along the part cylindrical portion of the tubular element 102.

Figure 5:
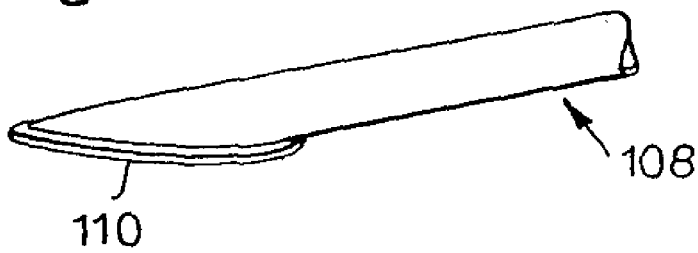
FIG. 5 is a schematic perspective view of a lateral liner portion of the first embodiment.
Figure 6:
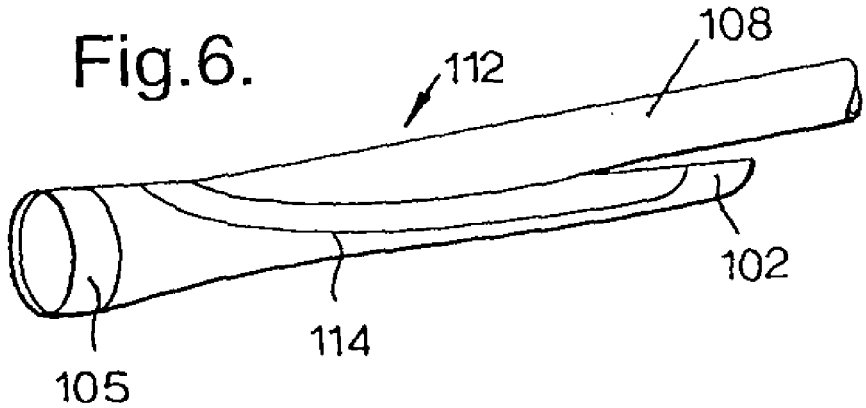
FIG. 6 is a schematic perspective view of a second embodiment of the present invention.

The aperture 106 receives a lateral liner portion 108 (see FIG. 5) which is attached to the tubular element 102 by means of welding. The lateral liner portion 108 is provided with a flange 110 at the end secured to the tubular element 102 so as to assist with its correct location relative to said element 102. The lateral liner portion 108 is inserted through the tubular aperture 106 and welded so that the flange 110 abuts the interior surface of the tubular element 102. As an alternative arrangement, the flange 110 may be secured to the exterior surface of the tubular element 102. In a development of the flange liner 100, FIG. 6 shows a second embodiment 112 of the present invention wherein a ring seal element 114 has been provided on the external surface of the tubular element 102 about the lateral liner portion 108. The seal element 114 can be bonded to said external surface by means of an appropriate adhesive or retained within a channel or groove defined in or on said surface. In use, the seal element 114 abuts the main borehole casing and encircles the casing window so as to assist in preventing fluid flow between the lateral borehole and the region located between the main borehole casing and the tubular element 102.

Each flange liner 100,112 is sized in view of the main and lateral boreholes with which it is to be used. The diameters and radii of each liner 100,112 are critical in as much as a close fit of liner components 102,108 relative to the main and lateral boreholes is desirable in order to eliminate shale ingress into the main borehole casing. With this in mind, it should be understood that in use, each flange liner 100,112 is intended to finally locate with the lateral liner portion 108 projecting into the lateral borehole. Whilst in this position, the part spherical node 105 should abut the full circumference of the internal surface of the main borehole casing and an area of tubular element 102 encircling the lateral liner portion 108 should also abut an area of said internal surface encircling the casing window.

Figure 7:
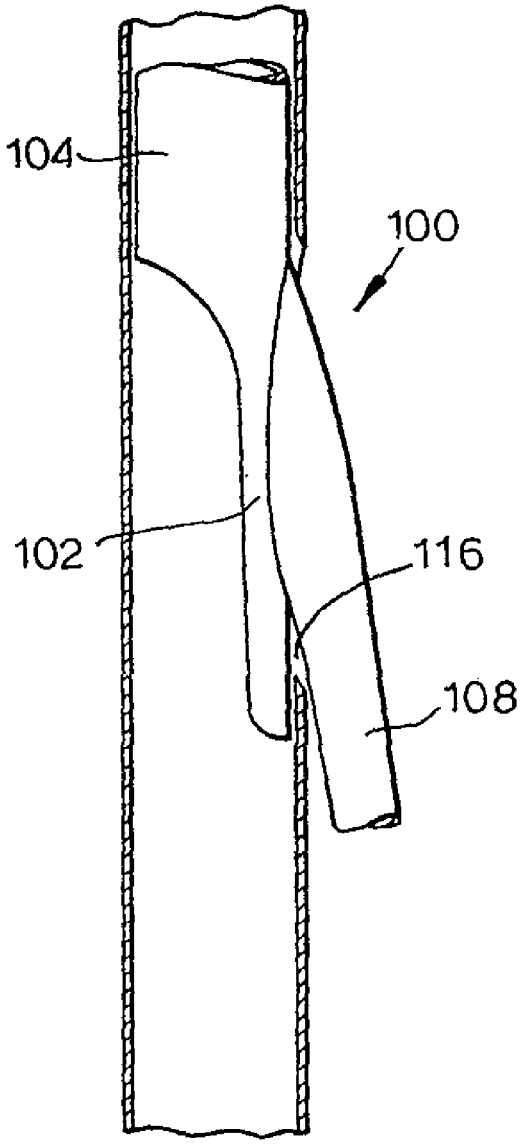
FIG. 7 is a partial cross-sectional view of the first embodiment located in a final position adjacent a casing window.

A schematic part cross-sectional view of the first embodiment 100 is shown in FIG. 7 located in the above described final position. It will be seen that the downhole edge 116 of the casing window is in abutment with both the external curved surfaces of the tubular element 102 and lateral liner portion 108. As such, said downhole edge 116 may support the weight of the flange liner 100 and prevent further movement thereof down the main and lateral boreholes.

However, each flange liner 100,112 is primarily sized so as to allow it to run smoothly through the main borehole casing prior to achieving the ideal final position indicated above. Accordingly, each flange liner 100,112 must be sized so as to be deployable through the radii of curvature commonly found in well bores (for example, up to 15°/100' for a 7" casing—but not limited to such cases). For a 7" main borehole casing, the lateral liner portion 108 may be provided as a 4½" tubing.

In order to assist with running the aforementioned flange liners 100,112 in hole and to minimise deflection of lateral lining attached to the downhole end of the lateral liner portion 108, one or more flex joints (such as a knuckle joint) are located in said lateral liner. It is particularly desirable to locate a flex joint adjacent said downhole end of the lateral liner portion 108. The use of means for allowing bending of said lateral lining (particularly that lining located adjacent liner portion 108) will reduce the possibility of lateral lining collapse or, indeed, kinking or crimping of the flange liners 100,112 themselves.

Despite the use of flex joints, the ideal dimensions of a flange liner (from the view point of its final position as discussed above) may be compromised by the need to run through a main borehole having, for example, a particularly restrictive radius of curvature. In these circumstances, the main/lateral junction sealing characteristics associated with the flange liner alone may not be adequate. It may then be necessary to incorporate cementing port collars and external casing packers in the lateral tubing string so that the area surrounding the main/lateral junction can be cemented if so desired. An effective barrier to shale ingress can be thereby created.

Although the two flange liners 100,112 described above are located in position adjacent a casing window by engagement of the downhole window edge 116 (see FIG. 7) with both the tubular element 102 and the lateral liner portion 102, a mechanical anchoring device should ideally also be provided adjacent the uphole end 104 of the tubular element 102. Such a device may be set with any appropriate means (for example, string weight or hydraulics) and is particularly desirable since it prevents uphole movement of a flange liner. However, it should be appreciated that such a device may not be necessary in certain circumstances (for example, in a relatively simple main/lateral junction arrangement). Where an anchoring device is used, annular seal assemblies may be provided (possibly as part of said device) adjacent the uphole end of the flange liner.

Figure 8:
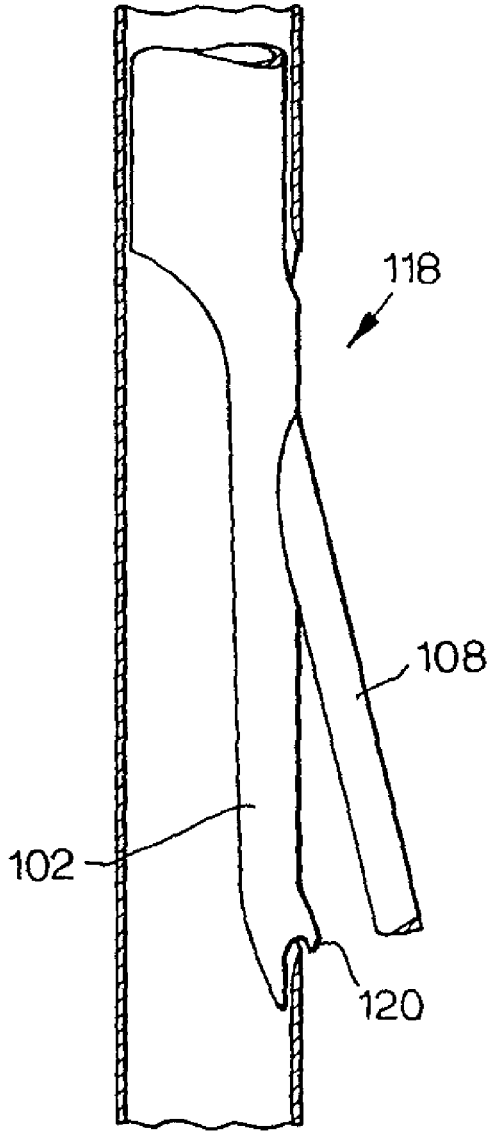
FIG. 8 is a partial cross-sectional view of a third embodiment of the present invention located in a final position adjacent a casing window.

Also, as shown by the third embodiment 118 in FIG. 8, the aforementioned final position adjacent a casing window can be achieved by the engagement of a laterally extending protrusion 120 with a downhole edge of said window. The protrusion 120 extends laterally from a downhole portion of the tubular element 102 spaced downhole from the lateral liner portion 108. The protrusion 120 and tubular element 102 form a hook shape having a generally downwardly facing opening for receiving the downhole window edge as the third flange liner 118 is pressed down the main borehole.

Figure 9:
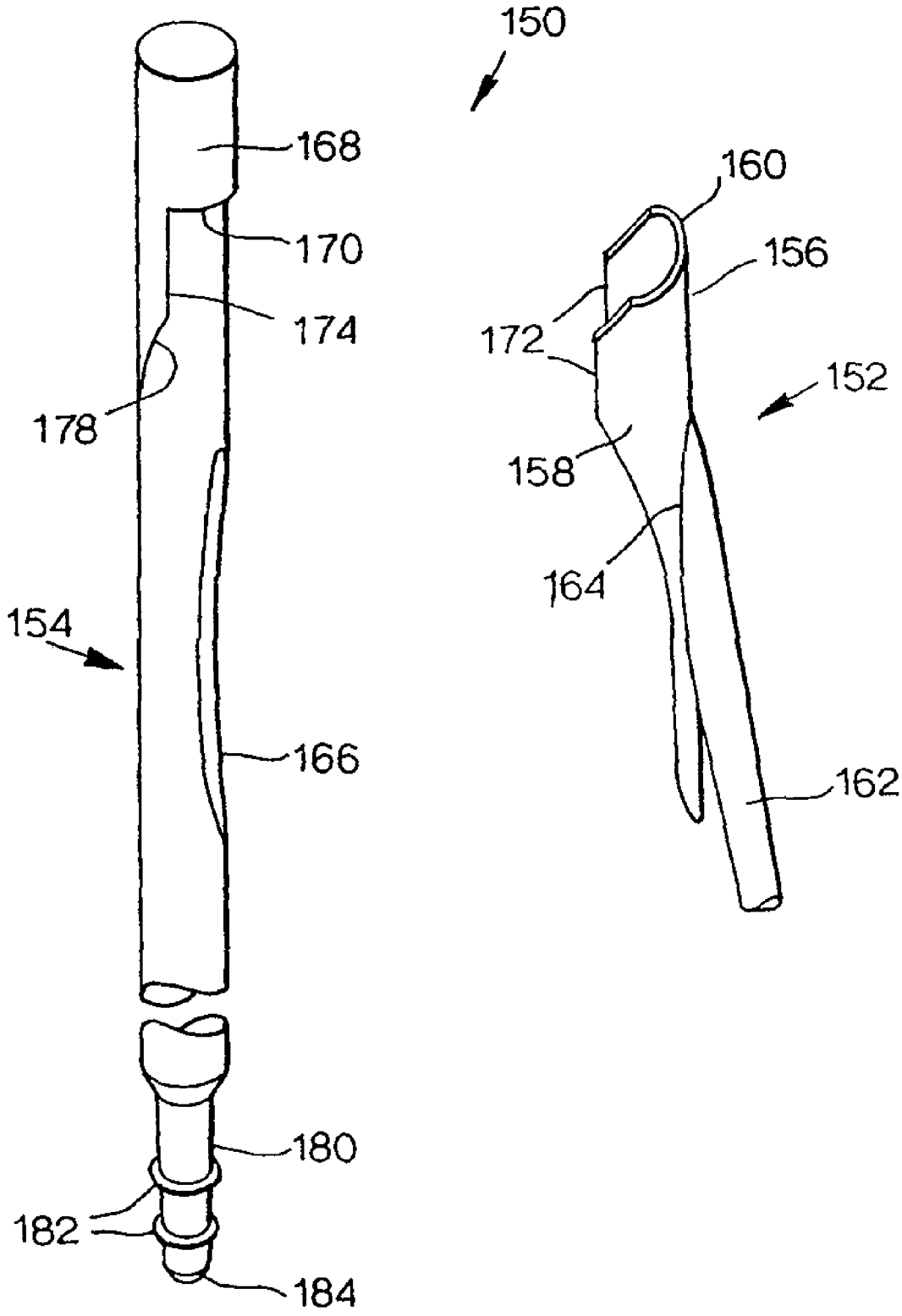
FIG. 9 is a schematic perspective view of a fourth embodiment of the present invention.

A fourth embodiment 150 of the present invention is shown in FIG. 9 of the accompanying drawings. The fourth flange liner 150 is provided as two discrete components 152,154. The first discrete component 152 is largely identical to the first flange liner 100 shown in FIG. 4 and is manufactured in the same manner. The first component 152 may however be based on the design of the second or third flange liners 112,118 (with the same modifications as described hereinafter with relation to the first liner 100). The only difference between said first component 152 and the first flange liner 100 is that said first component 152 has a modified uphole end 156 of the tubular element 158. The modified uphole end 156 is part cylindrical (rather fully cylindrical with a spherical node) and has an upper edge 160 for abutment with the second discrete component 154. A lateral liner portion 162 extends from an elliptical aperture 164 in the tubular element 158.

The second discrete component 154 is an elongate cylindrical sleeve having a preformed window 166 which, in use, is aligned with the window provided in the main borehole casing. The preformed window 166 is substantially the same size and shape as the main borehole window and, when in its final downhole position, locates on the opposite side of the tubular element 158 therefrom. An uphole end 168 of the second component 154 is provided with a downhole facing shoulder 170 for pressing downwardly on the upper edge 160 of the first discrete component 152. The shoulder 170 extends in a circumferential direction about the second component 154 and is axially located so that the aperture 164 of the first component 152 axially aligns with the preformed window 166 when the shoulder 170 and upper edge 160 abut one another. Angular alignment of the aperture 164 and preformed window 166 is ensured by the abutment of two longitudinally extending edges 172 of the first component 152 with two longitudinally extending shoulders 174 on the second component 154 (only one visible in the view of FIG. 9). The longitudinal edges 172 of the first component 152 continue downwardly from the upper edge 160 and the longitudinal shoulders 174 continue downwardly from the downhole facing shoulder 170. The two longitudinal shoulders 174 themselves continue downwardly into a mule shoe profile 178 which, in use, can be received in a mating profile within the main borehole casing so as to correctly orientate the flange liner 150 and ensure that the lateral liner portion 162 aligns with the main borehole window.

The uphole end 168 of the second component 154 is provided with anchor and seal means (not shown). The downhole end of the second component 154 is provided with a seal sub 180 having circumferential seal elements 182 and a bullnose/wireline entry guide 184 at its lowermost end. The second component 154 may also be provided with a whipstock/deflector latch profile located between the seal sub 180 and the preformed window 166 so as to assist with depth and orientation finding.

In use, the fourth flange liner 150 is run downhole with first component 152 axially displaced so that the lateral liner portion 162 is located substantially below the second component 154. This arrangement allows the liner 150 to locate within the internal diameter of the main borehole casing. The liner portion 162 (or attached lateral liner tubing) preferably runs in contact with the main borehole casing so that, as said portion 162 approaches the main borehole window and the liner 150 is appropriately orientated by the aforesaid means, the liner portion 162 (or attached tubing) tends to spring into the main borehole window. Biasing means may alternatively be provided for biasing the liner portion 162 (or attached liner tubing) into the window. The first component 152 then locates in the main borehole window as described in relation to FIG. 7. The second component 154 concurrently runs downhole so that the preformed window 166 aligns with the aperture 164 and the main borehole window. In so doing, the shoulder 170 abuts the upper edge 160 and presses the lateral liner portion 162 firmly into the lateral borehole. The outer diameter of the second component 154 is substantially identical to the inner diameter of the tubular element 158. Also, the outer diameter of the tubular element 158 is substantially identical to the inner diameter of the main borehole casing, Thus, the presence of the second component 154 adjacent the main borehole window ensures that the tubular element 158 is pressed firmly against the internal surface of the casing. Indeed, the tubular element 158 is firmly squeezed between the second component 154 and the main borehole casing so as to provide a good seal about the main/lateral junction.

As the second component 154 aligns with the main borehole window, the seal sub 180 locates in a Polished Bore Receptacle (PBR) secured below the window within the main borehole.

It may be preferable to run the flange liner 150 downhole without a full length of lateral liner tubing attached to the lateral liner portion 162. This may be the case even though said liner tubing is provided with one or more flex joints. It may therefore be desirable to provide the downhole end of the lateral liner portion 162 with an inwardly projecting flange (i.e. a landing profile). The liner 150 may then be located in a main borehole window prior to the running of a lateral liner tubing through the lateral liner portion 162. The lateral liner tubing may be provided with a profile for making with the flange on the lateral liner portion 162.

Figure 10:
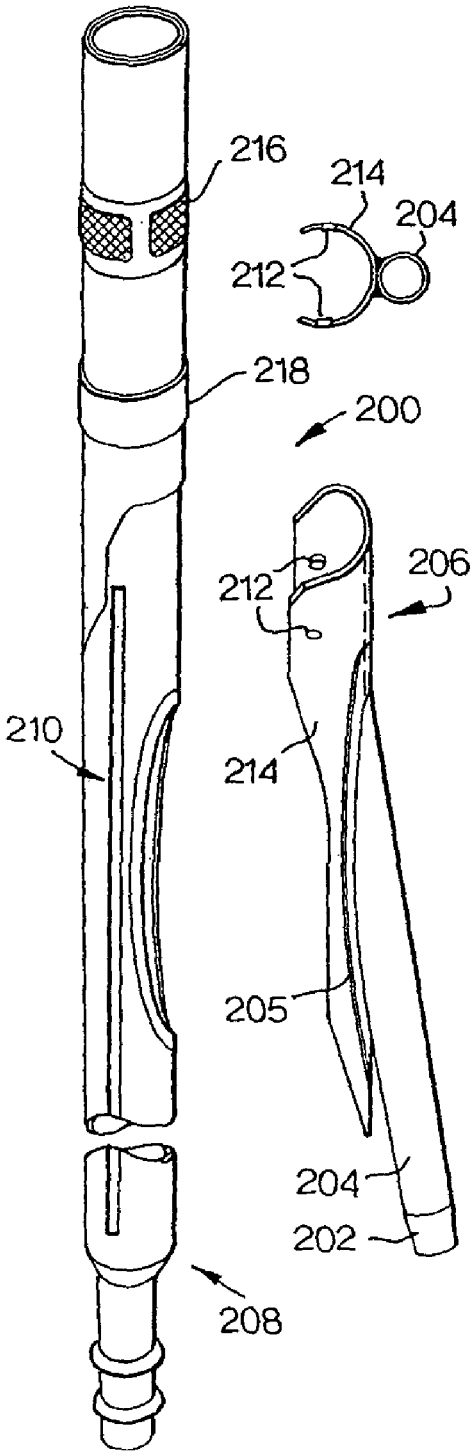
FIG. 10 is a schematic perspective view of a fifth embodiment of the present invention.
Figure 11:
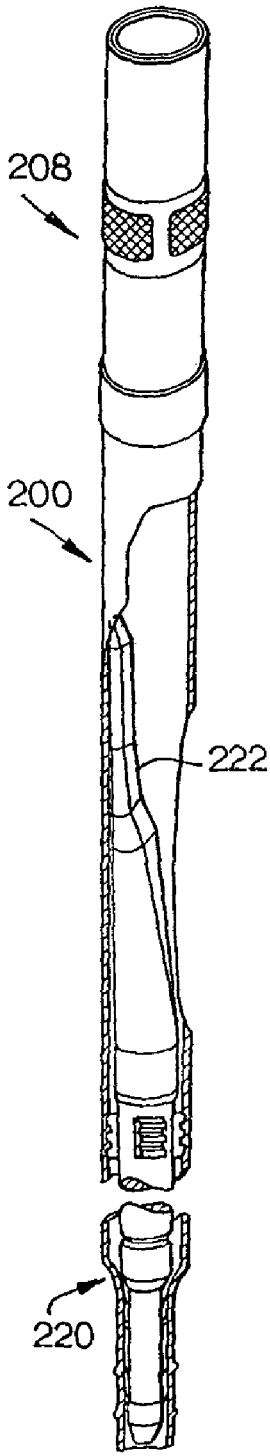
FIG. 11 is a schematic partial internal view of the fifth embodiment.
Figure 12:
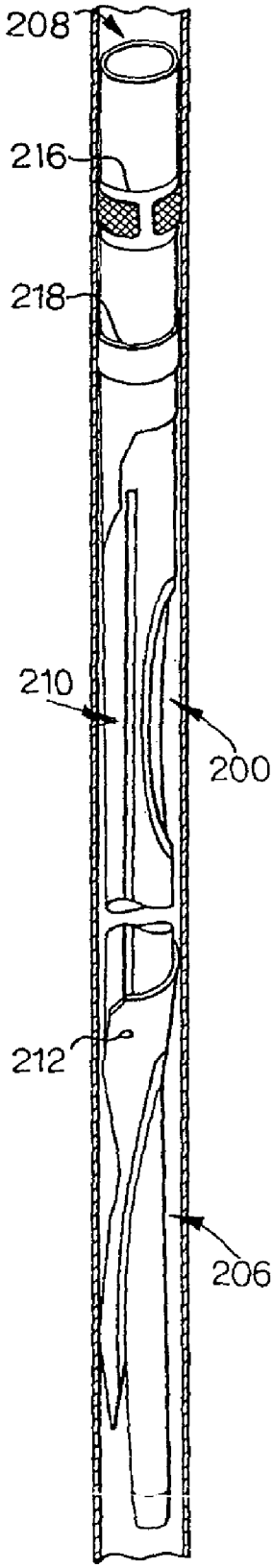
FIG. 12 is a schematic perspective view of the fifth embodiment within a main borehole casing.
Figure 13:
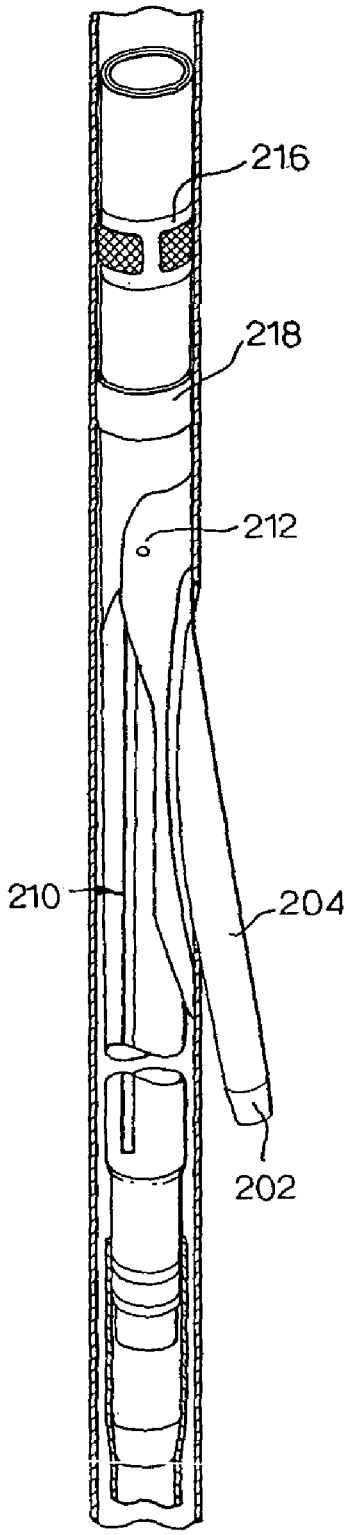
FIG. 13 is a schematic perspective view of the fifth embodiment located adjacent a main borehole window.

A fifth embodiment of the present invention is shown in FIGS. 10 and 11. The fifth flange liner 200 is identical to the fourth flange liner 150 except for the provision of a landing profile 202 (as mentioned above) on the downhole end of the lateral liner portion 204, the provision of a ring seal element 205 (as described in relation to the second flange liner 112 of FIG. 6) and the provision of a guide pin/slot system for ensuring the correct orientation of the first discrete component 206 relative to the second discrete component 208. The guide pin/slot system comprises two elongate slots 210 (only one of which is visible in the view of FIG. 10) along a length of the second component 208. The guide system further comprises two guide pins 212 projecting from the inner surface of the uphole end of the tubular element 214. In use, the fifth flange liner 200 is run in whole with the two guide pins 212 slidably located in the elongate slots 210. Thus, the guide pin/slot system allows relative axial movement between the first and second discrete components 206, 208 without relative rotational movement therebetween (see FIGS. 12 and 13). In an alternative arrangement, guide slots may be provided in the tubular element 214 with cooperating guide pins being provided on the second discrete component 208.

As described in relation to the fourth flange liner 150, the uphole end of the second component 208 is provided with anchor means 216 and seal means 218.

A schematic internal view of the fifth flange liner 200 is shown in FIG. 11. It will be seen that the interior of the second discrete component 208 comprises an internal latch profile 220 at a downhole end thereof for receiving a deflector 222. In use, the deflector 222 is employed to deflect the subsequently run lateral liner tubing into the lateral borehole. The lateral liner tubing is preferably conveyed in whole with an acidizing string made up internal to said liner. The acidizing string is provided with wrapped screens such that acidizing of formation can be carried out concurrently. The use of an acidizing string can be adapted to use with all the flange liners mentioned herein. Once the lateral liner tubing has been located within the lateral borehole, the acidizing string may be retrieved and the deflector 222 recovered from the flange liner 200 so as to allow full access to the main borehole below the main/lateral junction.

Where size is not a constraint, the lateral borehole need not be drilled immediately after cutting the main borehole window and subsequently milling rat hole (i.e. a pilot hole). Instead, the flange liner 200 may be deployed as previously described and the lateral borehole drilled off the deflector 222. The completion string i.e. the lateral liner tubing) and acidizing string may then be run into the lateral borehole. The acidizing string, deflector 222 and any debris barrier may then be recovered.

Figure 1:
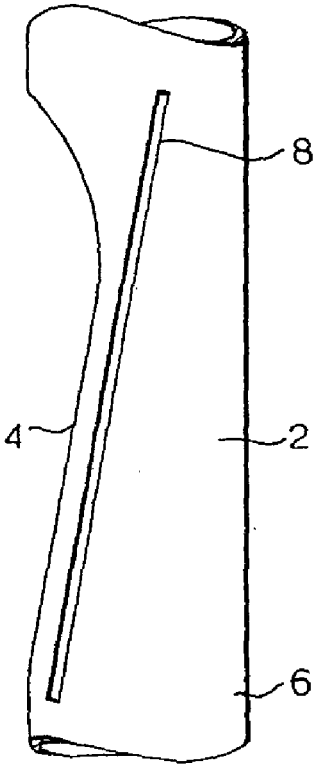
Fig.1. PRIOR ART.
FIG. 1 is a schematic perspective view of a prior at hook hanger system.
Figure 2:
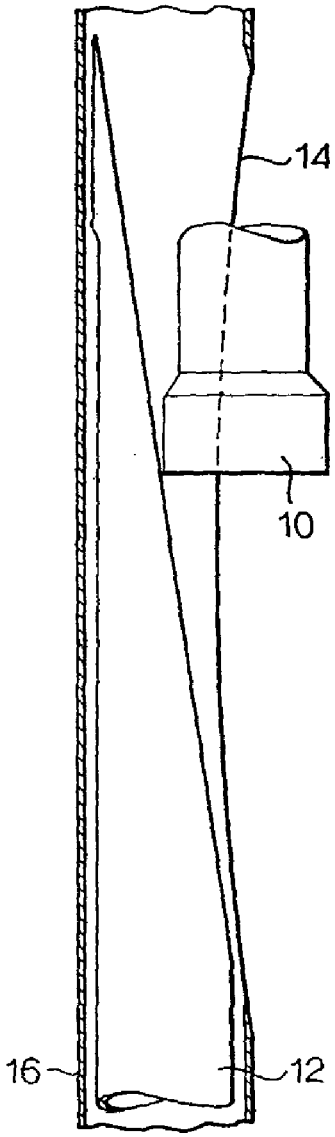
Fig.2. PRIOR ART.
FIG. 2 is a schematic cross-sectional view of conventional mill and whipstock cutting a casing window.
Figure 3:
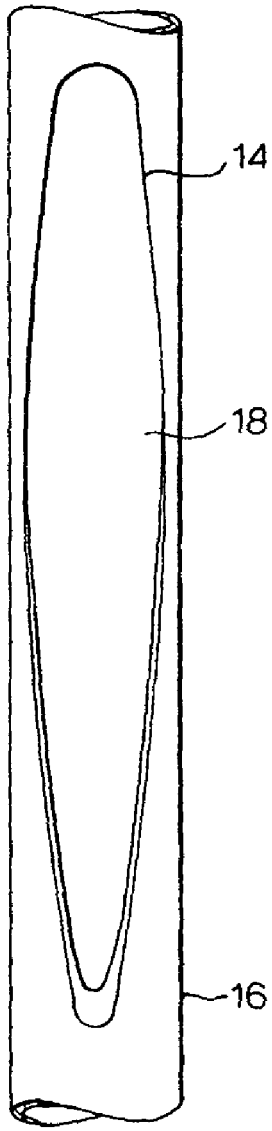
Fig.3. PRIOR ART.
FIG. 3 is a schematic perspective view of the casing window of FIG. 2.

The aforementioned flanged liners may be used with main borehole windows having standard geometries (for example, the casing window 14 shown in FIG. 3). Such windows may include Widetrack, Gauge Max, and possibly even Extended Gauge, all being predominantly variations on Trackmaster windows produced using multi-ramp whipstock profiles. The most appropriate form of window may be one which is an extended gauge widetrack. Such a window comprises a standard cut out, extended widetrack (maximum width section as produced with Gauge Max, but having a shorter length) and a runout which causes tapering at the bottom of the window, but which allows mill exit into formation when cutting a rat hole (i.e. a pilot hole for the drilling assembly).

Figure 14:
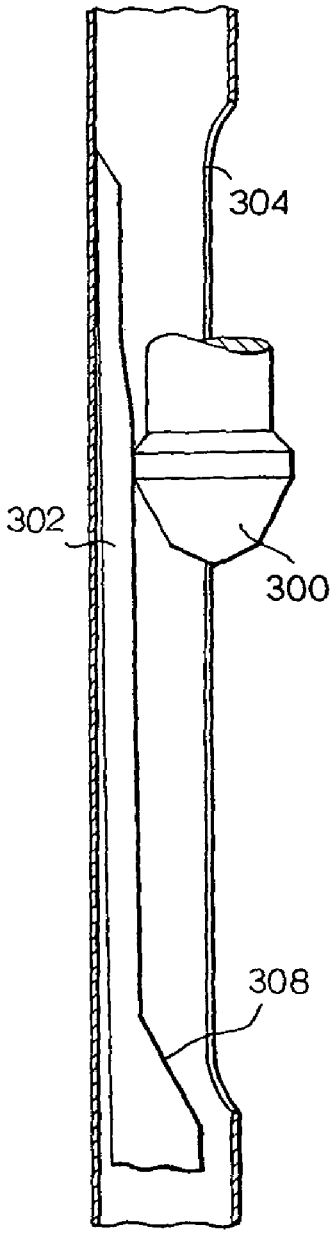
FIG. 14 is a schematic part cross-sectional view of a mill and whipstock system for cutting a preferred window profile.
Figure 15:
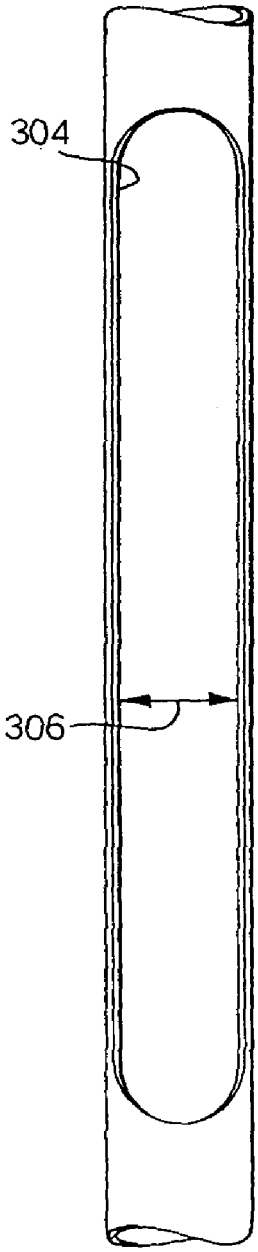
FIG. 15 is a schematic perspective view of the preferred window of FIG. 14.

A casing window particularly suited to use with the aforementioned flange liners is shown in FIGS. 14 and 15 of the accompanying drawings. Using a Trackmaster mill 300 and whipstock 302 system having controlled gauge, it is possible to provide a window 304 having a maximum width 306 substantially equal to the mill 300 maximum diameter for the majority of the window length. This window profile is achieved by the whipstock 302 having a concave height which remains essentially constant. As a result, the mill 300 travels from adjacent the top of the window to adjacent the bottom of the window whilst cutting with its maximum diameter. This may be contrast with the prior art hook hanger system wherein the maximum width of the window 14 extends over a very short length. Consequently, the location of the maximum window width is more difficult to predict in the prior art system and complicates installation of the completion assembly.

With the window profile shown in FIGS. 14 and 15, it is possible to drill off the whipstock 302 into the surrounding formation—not having exited into the formation with the mill 300 when cutting the window 304. Drilling of the concave would necessitate use of a directional motor with a bent housing orientated to drive the drilling bit into the formation. Alternatively, a drilling bit could be deflected into the formation using a deflector which has been installed so as to replace the whipstock 302 used to mill the window 304. As a further alternative, the whipstock 302 could be anchored uphole of the position shown in FIG. 14 so that the lowermost ramp 308 of said whipstock 302 can be used to deflect the drilling bit through the window 304.

Figure 16:
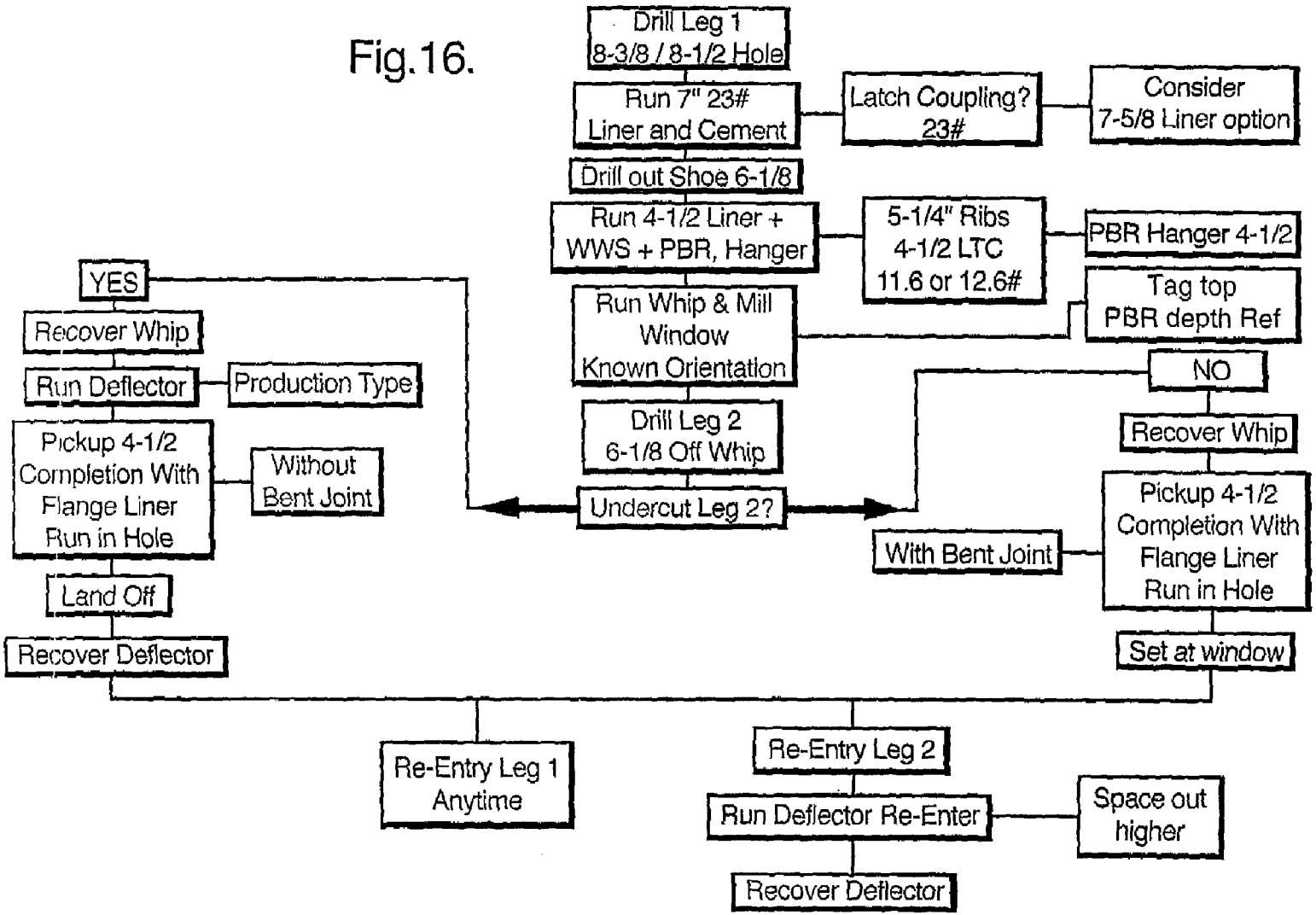
FIG. 16 is a table of procedural steps for completing a lateral borehole.

A completion process chart is provided in FIG. 16 of the accompanying drawings wherein the steps to be taken in completing a natural borehole (leg 2) with an undercut (without a bent joint) or without an undercut (with a bent joint) are indicated. The concurrent running of a lateral tubing string 400 and the first flange liner 100 through a window 402 provided in a main borehole casing 404 (between the dotted lines labelled with reference numeral 406) is shown in the queue sequences of FIGS. 17 to 19 and FIGS. 20 to 21. The first sequence shown in FIGS. 17 to 19 relate to the completion of lateral borehole with no undercut (i.e. through use of a bent joint). The second sequence shown in FIGS. 20 to 21 show the completion of a lateral borehole with an undercut (i.e. through use of a deflector 408). In each sequence, the flange liner 100 is connected to the lateral liner tubing 400 by means of a flex joint 410.

The completion operations summarised in the aforementioned two sequences make use of a widetrack whipstock. A plan view of the deflecting surface of said widetrack whipstock 412 is shown in FIG. 22 wherein the location of the cut window 402 in relation to a fully deployed flange liner 100 is shown by means of the aforementioned dotted lines 406. Cross-sectional views of the flange liner 100 at various longitudinal positions along its length are also shown in FIG. 22 wherein the lateral position of said flange liner relative to the longitudinal axis 414 of the casing 404 is presented. By way of contrast, FIG. 23 shows a gauge max whipstock 416 with the associated window and flange liner 100 positions being indicated by the aforementioned dotted lines 406. It will be appreciated that the dotted lines 406 relate to a different window to the window 402 referred to in respect of FIGS. 17 to 22. Cross-sectional views of the flange liner 100 are also shown in FIG. 23 in a similar manner as shown in FIG. 22. A sixth embodiment 500 of the present invention is shown, in part, in FIGS. 24 and 25. The sixth flange liner 500 is identical to the fifth flange liner 200 except that the lateral liner portion 502 is formed in a collapsed state so as to allow the flange liner to locate within the main borehole casing. It will be noted that FIGS. 24 and 25 merely show a first discrete component 504 for replacing the first discrete component 206 of the fifth flange liner 200. A second discrete component (corresponding to the second discrete component 208 of the fifth flange liner 200) in respect of the sixth flange liner 500 is not shown in FIGS. 24 and 25.

The collapsed lateral liner portion 502 may be resiliently deformed as shown in FIGS. 24 and 25 so that the illustrated deformed shape is retained by means of lateral force applied by the chasing of the main borehole. Thus, in these circumstances, once the first discrete component 504 locates adjacent the main borehole chasing, the lateral liner portion 502 will tend to spring back to its original tubular shape. In this regard, the lateral liner portion 502 may be manufactured from titanium or any suitable alloy. Alternatively, the collapsed lateral liner portion 502 may be reformed into a tubular shape by mechanical, hydraulic, explosive or any other suitable means.

The present invention is not limited to the specific embodiments and methods described above. Alternative arrangements and suitable materials will be apparent to the reader skilled in the art. For example, any one of the aforementioned flange liners may be used in conjunction with a main borehole casing which has been provided with an eccentric joint. Such an arrangement is shown in FIGS. 26 and 27 wherein the fourth flange liner 150 is run through a portion of main borehole casing having two overlapping internal diameters 602, 604.

Inventor comments in respect of the system shown in FIGS. 26 and 27 are as follows:

Provide a joint of casing shaped like a gas lift mandrel (25 to 30 feet in length). The window would be created or, better still preformed, at the lower most end of the eccentric part of the joint. There would be a MOLE like profile sub run below this joint for a depth and orientation datum point. The top most part of the eccentric joint would house a sliding sleeve 154 with a preformed window 166 in it just slightly larger than the main borehole window.

Operation would be as follows

1) Drill 8½" hole or larger to depth.
2) Run 7" casing with one or more Gas lift mandrel shaped eccentric joints (EJ) with MOLE equivalent profile subs below each joint.
3) Orientate the EJ's to the desired azimuth (preferably high side).
4) Cement the casing string in place (the ID and the EJ would be lined with a compound that could be jetted away with a jet wash tool).
5) Run the jet wash tool to remove the lining (perhaps even an acid soluble lining).

6) Run the whipstock/deflector and latch into the MOLE sub, set the packstock and drill ahead to depth.
7) Run the lateral to completion with the saddle 152 and land off. The running tool must extend into the lateral liner and it must have a hydraulic and/or mechanical release mechanism so that is can withstand pushing and pulling to get the completion to bottom. A telescopic joint with a lock ring assembly above where the running tool locates may be used. Once the completion is landed and the running tool is released, pick up and use the completion running tool to close the telescopic joint and drive home the saddle 152.
8) Once the saddle 152 is seated, pull out of the hole and run in with a tool to engage the sliding sleeve 154 and force it down to sandwich the saddle. The bottom of the sleeve may incorporate a latch to lock it into position.
9) Move up and do the next lateral borehole.

The invention claimed is:

1. Downhole apparatus for sealing a junction between a main borehole and a lateral borehole, the apparatus comprising: a first component formed by a tubular liner for lining a portion of the lateral borehole adjacent the main borehole, and a flange element secured to the tubular liner, the flange element having a curved surface for location in abutment with an area of a main borehole wall surrounding the entrance to the lateral borehole; and a second component locatable in the main borehole to lock the first component in a use position in which said curved surface of the first component is held in abutment with said area of the main borehole wall, the second component comprising a cylindrical member having a cylindrical outer face for engaging an inner face of the flange element of the first component to lock the first component in said use position, an aperture being formed in the cylindrical member corresponding to a position of the tubular liner to provide entry into the tubular liner from the main borehole, wherein said flange element is elongate in shape and one end thereof is provided with an edge profile, said cylindrical member having a projection for abutment with said edge profile.

2. Downhole apparatus as claimed in claim 1, wherein said curved surface is part cylindrical.

3. Downhole apparatus as claimed in claim 1, wherein the edge profile includes an edge which faces uphole.

4. Downhole apparatus as claimed in claim 3, wherein the uphole facing edge is at an uphole extremity of the first component.

5. Downhole apparatus as claimed in claim 1, wherein the edge profile includes an edge which is parallel to an axis of the cylindrical member.

6. Downhole apparatus as claimed in claim 5, wherein the exterior surface of said cylindrical member about said aperture is provided with a seal element.

7. Downhole apparatus as claimed in claim 5, wherein said first component is secured to said second component by means for permitting relative axial movement between said first component and said second component without permitting relative rotational movement therebetween.

8. Downhole apparatus as claimed in claim 7, wherein said means comprises a pin slidably located in a slot.

9. Downhole apparatus as claimed in claim 8, wherein said pin is provided on said first component and said slot is provided on said second component.

10. Downhole apparatus as claimed in claim 7, wherein said means for permitting relative axial movement permits movement of said first component from a first position, wherein the longitudinal axis of said tubular liner is substantially in line with the longitudinal axis of said cylindrical member, to a second position, wherein said edge profile and shoulder are in abutment and the longitudinal axis of said tubular liner extends at an angle to the longitudinal axis of said cylindrical member.

11. Downhole apparatus as claimed in claim 1, wherein the exterior surface of said flange element about said tubular liner portion is provided with a seal element.

12. A method of sealing a junction between a main borehole and a lateral borehole, the method comprising the steps of: running the apparatus of claim 1 down a main borehole and locating the tubular liner within a lateral borehole; and pressing the first component into abutment with an area of main borehole wall surrounding an opening of the main borehole into the lateral borehole.

13. A method as claimed in claim 12, the method comprising the step of expanding said tubular liner from a folded condition to an unfolded condition which said tubular liner is generally cylindrical in shape.

14. Downhole apparatus for sealing a junction between a main borehole and a lateral borehole, the apparatus comprising: a first component formed by a tubular liner for lining a portion of the lateral borehole adjacent the main borehole, and a flange element secured to the tubular liner, the flange element having a curved surface for location in abutment with an area of a main borehole wall surrounding the entrance to the lateral borehole; and a second component locatable in the main borehole to lock the first component in a use position in which said curved surface of the first component is held in abutment with said area of the main borehole wall, the second component comprising a cylindrical member having a cylindrical outer face for engaging an inner face of the flange element of the first component to lock the first component in said use position, an aperture being formed in the cylindrical member corresponding to a position of the tubular liner to provide entry into the tubular liner from the main borehole, wherein said tubular liner comprises folded side walls so that, when unfolded, said tubular liner has a circular cross-section, and, when folded, said tubular liner has a cross-sectional area of less magnitude than the area of said circular cross-section.

* * * * *